US008105133B2

(12) United States Patent
Jayabalan

(10) Patent No.: US 8,105,133 B2
(45) Date of Patent: Jan. 31, 2012

(54) AIRFOIL MASK, AIRFOIL AND MASK SYSTEM

(75) Inventor: Navabalachandran Jayabalan, Singapore (SG)

(73) Assignee: Pratt & Whitney Services Pte Ltd, Singapore (SG)

( * ) Notice: Subject to any disclaimer, the term of this patent is extended or adjusted under 35 U.S.C. 154(b) by 946 days.

(21) Appl. No.: 12/045,093

(22) Filed: Mar. 10, 2008

(65) Prior Publication Data

US 2009/0173418 A1 Jul. 9, 2009

(51) Int. Cl.
*B24B 55/00* (2006.01)
*B05D 1/00* (2006.01)

(52) U.S. Cl. ..... 451/442; 118/301; 118/504; 216/46; 451/29

(58) Field of Classification Search ..... 118/213, 118/301, 406, 504, 505; 216/41, 45, 46; 239/103, 104, 150, 288; 415/200; 451/29, 451/442; 150/166
See application file for complete search history.

(56) References Cited

U.S. PATENT DOCUMENTS

| | | | | |
|---|---|---|---|---|
| 4,156,807 | A | 5/1979 | Howard | |
| 4,256,444 | A | 3/1981 | Suter | |
| 4,530,861 | A | 7/1985 | Sippel | |
| 4,594,761 | A | 6/1986 | Murphy | |
| 5,049,722 | A | 9/1991 | Corfe | |
| 5,437,724 | A | 8/1995 | Dansereau | |
| 5,565,035 | A | 10/1996 | Sylvestro | |
| 6,037,004 | A * | 3/2000 | Zajchowski et al. | 427/282 |
| 6,165,269 | A * | 12/2000 | Kathe | 118/505 |
| 6,177,038 | B1 | 1/2001 | Reed | |
| 6,179,387 | B1 | 1/2001 | Nasset | |
| 6,183,347 | B1 * | 2/2001 | Shaw | 451/36 |
| 6,258,226 | B1 * | 7/2001 | Conner | 204/279 |
| 6,273,676 | B1 * | 8/2001 | Brooks et al. | 415/191 |
| 6,296,705 | B1 * | 10/2001 | Ireland et al. | 118/505 |
| 6,520,838 | B1 | 2/2003 | Shaw | |
| 6,695,587 | B2 * | 2/2004 | Wustman et al. | 416/241 R |
| 6,913,442 | B2 * | 7/2005 | Das et al. | 415/210.1 |
| 7,174,599 | B2 * | 2/2007 | Stiles | 15/257.01 |
| 2003/0232139 | A1 * | 12/2003 | DeTura | 427/282 |
| 2004/0097170 | A1 | 5/2004 | Bolz et al. | |
| 2005/0100672 | A1 | 5/2005 | Stankowski et al. | |
| 2005/0227589 | A1 * | 10/2005 | Oussaada et al. | 451/29 |
| 2009/0110831 | A1 * | 4/2009 | Mase et al. | 427/282 |

FOREIGN PATENT DOCUMENTS

| | | |
|---|---|---|
| EP | 0518102 | 12/1992 |

OTHER PUBLICATIONS

Search Report mailed Feb. 5, 2009.

* cited by examiner

*Primary Examiner* — Timothy V Eley
(74) *Attorney, Agent, or Firm* — Carlson, Gaskey & Olds, PC

(57) ABSTRACT

A mask for performing high speed media finishing on airfoils includes a thicker portion and a thinner portion. The thicker portion is spaced further from an edge that will become a leading edge in the final airfoil than the thinner portion. The media is redirected by the thicker portion toward the edge where the finishing is to occur.

5 Claims, 1 Drawing Sheet

AIRFOIL MASK, AIRFOIL AND MASK SYSTEM

RELATED APPLICATIONS

This application claims priority to Singapore Application No. 200800203.2, filed Jan. 9, 2008.

BACKGROUND OF THE INVENTION

This application relates to a mask for a trailing edge of an airfoil.

Airfoils, such as used as compressor blades for gas turbine engines, are in part formed with a shearing operation. The leading edge of the airfoil is initially an unprofiled blunt edge after the shearing operation.

Typically, the airfoil and the rest of the blade are placed in a high speed media finishing centrifuge. Media is directed at high speed toward the leading edge such that the initial blunt edge is formed into a smoother rounded edge in a final desired shape that helps facilitate airflow. Essentially, small stones are moved at a high speed toward the leading edge to create the rounded surface.

In the prior art, the remainder of the airfoil which does not need rounding is masked by tape. Although the tape does protect the airfoil, the tape does not serve to direct the media toward the leading edge. Instead, the thin vinyl tape only serves to protect the non-repaired area from erosion by preventing contact from media.

SUMMARY OF THE INVENTION

In the disclosed embodiment of this invention, a mask for a trailing edge of an airfoil is formed to have a slot extending from an open end inwardly to an inner end. A thicker portion of the mask is spaced further away from the open end and thinner portions are spaced toward the open end. The thicker portion of the mask serves to redirect media stones toward the leading edge, thus creating a more efficient media finishing operation.

These and other features of the present invention can be best understood from the following specification and drawings, the following of which is a brief description.

DETAILED DESCRIPTION OF THE PREFERRED EMBODIMENT

Figure 1:
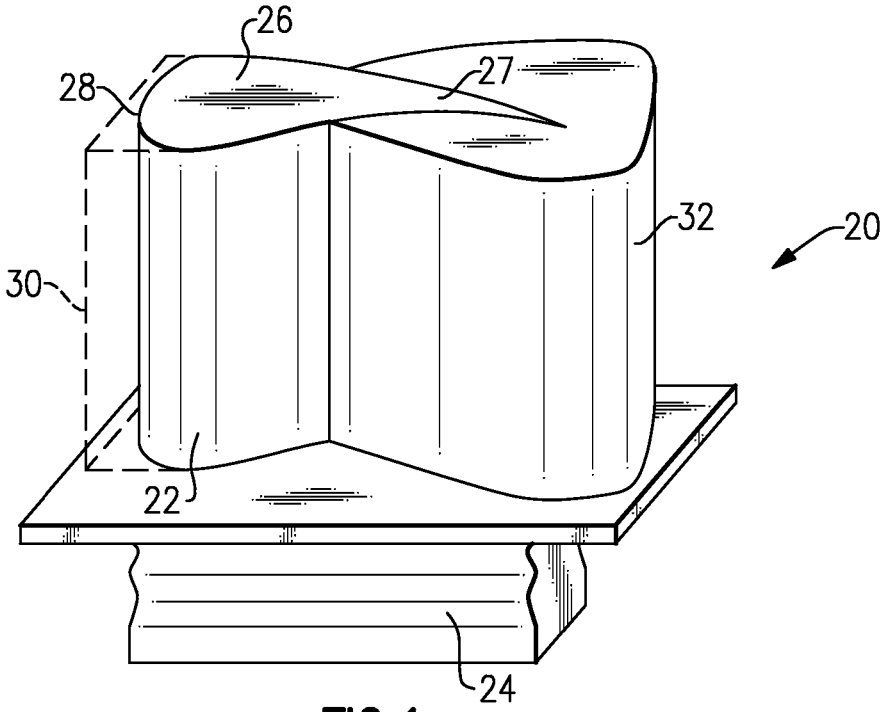
FIG. 1 is a perspective view of a blade and mask.

An exemplary blade and mask system 20 is illustrated in FIG. 1. The blade 22 has a platform and root section 24, and an airfoil 26. In a final form, the airfoil 26 has a leading edge 28 and a trailing edge 27. Initially, the airfoil 26 is formed from an initial metal medium using a shearing operation such that a blunt shearing edge 30 remains after the shearing operation. Subsequently, a media finishing operation is performed to round the shearing edge of the intermediate part to the final leading edge 28. A mask 32 is mounted on the trailing edge 27 during this tumbling operation. As shown in the figure, the blade 22 is slipped into the pre-fabricated masking "fixture" by being moved into slot 38.

Figure 2:
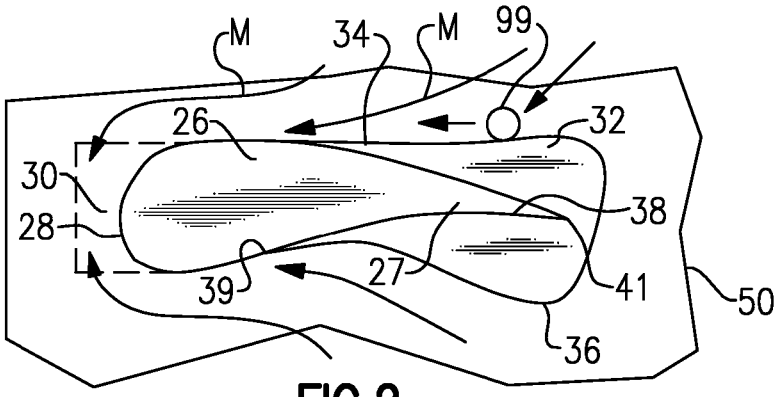
FIG. 2 is a schematic view of the mask and blade within a centrifuge.

As shown in FIG. 2, a centrifuge tumbling system 50 is used for a media finishing the airfoil 26. The mask 32 has thicker portions 36 more removed from the leading edge 28 than thinner portions 34, which are spaced toward the leading edge 28. Stated another way, the mask is thicker at areas adjacent to the trailing edge, and thinner at locations spaced toward the leading edge. As shown, an outer periphery surface of the mask 32 is substantially curved at the thicker portions 36 and tapers inwardly towards the thinner portions 34. The media is now directed more toward the leading edge 28 and the shearing edge 30 to be removed. As shown schematically, one media stone 99 has struck the outer periphery surface of the mask 32 adjacent to thicker portion 36. A trajectory of the stone 99 will now be changed toward the leading edge 28.

Figure 3:
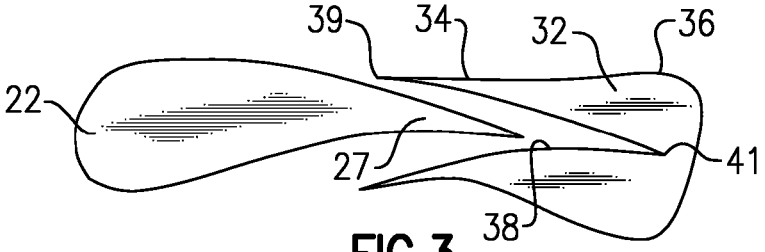
FIG. 3 shows the removal of the mask from the blade.

As can be appreciated from FIGS. 2 and 3, the slot 38 has an open end 39 extending inwardly to an inner end 41. The trailing edge 27 of the airfoil extends into the inner end 41. The thinner portions 34 can be seen to be spaced toward the open end 39 relative to the thicker portions 36. As shown in the figures, the outer profile of the mask 32 from the thicker portions 36 leading to the thinner portions 34 is curved to guide the media 99 toward the blunt edge 30 to facilitate formation of the leading edge 28. Shapes other than curves may be utilized. Further, the terms "thicker" and "thinner" are defined by the distance from the trailing edge 27 to an outer profile of the mask at the locations when the mask is received on an airfoil. While the thicker portion 36 may not redirect all of the media toward the blunt edge 30, it will serve to redirect a good deal of the media towards the edge 30.

The prior art tape, which was of a thin, uniform width, would not direct any more media toward the edge than what may have been directed in some other direction.

While a centrifuge tumbling system is disclosed, the mask can be utilized with other tumbling machines for media and stock removal and for rounding operations. As an example, vibratory tumbling machines could benefit from the disclosed mask.

As compared to typical media finishing operations, the media finishing utilizing such a mask is done much more efficiently, in that the media is concentrated on the area to be finished.

As shown in FIG. 3, once the media finishing operation is complete, the mask 32 can be easily removed from the airfoil 22. The mask 32 is preferably formed of a suitable material, such as rubber or plastic. Generally, the mask can be made of a material that is flexible enough to mount the blade, but rigid enough not to deform under the media impact. In one embodiment, a rubber material that temporarily deforms to allow mounting and returns to original shape, and maintains its shape during the process was used.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A mask for an airfoil comprising:

a slot having an open end and extending into an inner end, said slot to be received on a trailing edge of the airfoil;

the mask being thicker at a location spaced away from said open end, and thinner at a location adjacent to the open end, with the thicker location directing media in a direction of the open end when the mask is assembled on an airfoil, and within a media finishing process; and outer surfaces of said mask curve substantially inward in a direction from said thicker location toward said thinner portion.

2. The mask as set forth in claim 1, wherein the substantially inward curve of the outer surfaces directs media toward the open end.

3. An airfoil and a mask system comprising:

an airfoil having an intermediate blunt edge that is to be formed into a leading edge, and a trailing edge;

a mask having a slot with an open end extending into an inner end, said slot received on said trailing edge of the airfoil;

the mask being thicker at a location spaced away from said open end, and thinner at a location adjacent to the open end, with the thicker location directing media in a direction of the leading edge when the mask and airfoil are within a media finishing process; and outer surfaces of said mask curve substantially inward in a direction from said thicker location toward said thinner location.

4. The system as set forth in claim 3, wherein the airfoil is to be part of a compressor blade for a gas turbine engine.

5. The system as set forth in claim 3, wherein the substantially inward curve of the outer surfaces directs media toward the leading edge.

* * * * *